United States Patent [19]

Zimmer

[11] Patent Number: 4,492,156

[45] Date of Patent: Jan. 8, 1985

[54] APPARATUS FOR COMPACTING REFUSE

[76] Inventor: John Zimmer, 502 Estate Dr., New Iberia, La. 70560

[21] Appl. No.: 456,574

[22] Filed: Jan. 10, 1983

[51] Int. Cl.[3] ..... B30B 15/06

[52] U.S. Cl. ..... 100/229 R; 100/49; 100/255; 100/295; 141/80; 141/390

[58] Field of Search ..... 100/53, 229 A, 229 R, 100/255, 49, 295, 221, 224, 100, 902; 141/71, 73, 80, 316, 390

[56] References Cited

U.S. PATENT DOCUMENTS

| | | | |
|---|---|---|---|
| 56,456 | 7/1866 | Levy et al. | 100/229 R |
| 312,968 | 2/1885 | Carey | 100/29 S |
| 2,224,908 | 12/1940 | Griffith | 141/390 |
| 2,641,122 | 6/1953 | Cavagnaro et al. | 100/229 R |
| 2,782,710 | 2/1957 | Fishburne | 100/229 R |
| 2,798,348 | 7/1957 | Weber et al. | 100/221 |
| 2,970,533 | 2/1961 | Allen | 100/229 A |
| 3,353,478 | 11/1967 | Hopkins | 100/229 R |
| 3,602,136 | 8/1971 | Ligh | 100/229 R |
| 3,754,503 | 8/1973 | Hennells | 100/229 A |
| 3,851,577 | 12/1974 | Newcom et al. | 100/255 |
| 3,862,595 | 1/1975 | Longo | 100/229 A |
| 3,868,903 | 3/1975 | Montalbano | 100/229 A |
| 4,008,658 | 2/1977 | Stock | 100/229 R |
| 4,022,123 | 5/1977 | Bachmann | 100/229 R |
| 4,212,240 | 7/1980 | Lee et al. | 100/255 X |

FOREIGN PATENT DOCUMENTS

| | | | |
|---|---|---|---|
| 421060 | 8/1946 | Italy | 100/255 |
| 567586 | 10/1957 | Italy | 100/229 R |

*Primary Examiner*—Billy J. Wilhite

*Attorney, Agent, or Firm*—Keaty & Keaty

[57] ABSTRACT

An apparatus for compacting refuse in a drum or in a bag, or of drums themselves, is provided with a frame mounted above a platform. The platform provides a base supporting a cylindrical jacket which encloses the media to be compacted. The jacket is mounted upon a movable platform, which is positioned under a compaction disk connected to a hydraulic ram during the compacting operation and removed from under the compaction disk, when the refuse is loaded into the jacket or removed from it. The platform slides from the operating zone eliminating hazardous conditions for an operator in case if the compaction disk accidentally descends during a non-operation. The jacket can be opened for loading of refuse within its walls and can be closed prior to positioning of the jacket under the compaction disk.

2 Claims, 18 Drawing Figures

APPARATUS FOR COMPACTING REFUSE

BACKGROUND OF THE INVENTION

1. Field of the Invention

The present invention relates to refuse compactors and more particularly relates to a compactor apparatus capable of compacting refuse in drums, or in bags (wherein the compaction is supported on its bottom and sides) or of compacting drums themselves.

2. General Background

In the offshore oil industry, drilling platforms are provided for the drilling of oil and gas which are very expensive structures that require space be minimized in order to save construction costs. The operating costs of drilling platforms is quite high and space is at a premium. One of the significant problems in the offshore oil industry is the removal of refuse generated from the rig which can be in the form of trash, garbage, paper products, scrap metal, containers, and the like. Oil and gas well drilling necessarily generates a large number of empty drums which are brought onto the rig for a variety of purposes such as the containment of fuel, oil for lubrication, grease, cleaning products, miscellaneous petroleum products, and the like. Thus, during the drilling process a large number of empty drums can be quickly generated which create a storage problem to the drilling platform which is at a lack of space at all times. A solution to this problem would be to dispose of the drums in a simple and economical fashion.

It would be of great utility to provide in a single apparatus for compaction of refuse in bags, or in drums (as 55 gallon oil drums, eg.) and to further be able to crush the drums themselves without refuse in them.

Compacting devices are known. Several devices have been patented which attempt to solve the problem of compacting trash so as to compact as much garbage or trash as possible within a small containerized space.

It is also known to provide some type of support during certain compaction processes such as balers, for example. The following patents briefly describe some devices which have been patented that attempt to solve the problem of compacting trash and/or supporting materials which are being compacted.

Bachmann in U.S. Pat. No. 4,022,123 discloses a garbage compactor comprising lower base and upper top horizontal plates connected by rigid bars, upon which a container for the storage of garbage is pivotally fixed and slidable, so that it may be swung around the bar and displaced along the bar. The top plate is a carrier for a hydraulic pressure assembly. A hinged wall of the octagonal container can be operated to provide for removal of a bag insert after it has been filled with compacted garbage.

Stock in U.S. Pat. No. 4,008,658 teaches the use of a trash compactor comprising a cylindrical waste receptacle and a loading chamber above the receptacle. The doors are operatively connected to the receptacle, which includes a power ram for compressing waste material. The device also comprises filters for removing particles contained in the atmosphere as a result of the compacting operation.

J. Longo in U.S. Pat. No. 3,862,595 discloses a movable vertical trash compactor comprising a base on which a refuse receptacle is located and which has a vertical column extending adjacent thereto. A ram mounted on the column is moved up and down into the container thus compacting the waste material in the container or receptacle.

W. Newcom, et al in U.S. Pat. No. 3,851,577 describe a vertical baler for baling paper scraps which is characterized by a hydraulic system being a structural integral part of the roof or the baler. The apparatus comprises a pair of pivotally mounted doors and a compacting cylinder is periodically caused to descend and compress the waste material which is then baled and ejected in a conventional manner.

D. Ligh in U.S. Pat. No. 3,602,136 discloses a refuse compactor comprising a cylindrical housing with an internal chamber, a compacting head arranged therein for guided axial sliding in the chamber. Refuse is introduced into the chamber through a door in a side wall of the chamber and then it is compressed by a hydraulic piston or a mechanical screw.

Hopkins in U.S. Pat. No. 3,353,478 discloses a waste collecting and compacting unit of a cabinet structure comprising an expendable receptacle with an open top, an electrically operated compression means for compressing the waste material which is then removed from the receptacle. The compacting member has a lead end irregular compressing surface to provide for the application of various pressure movements on irregular surfaces.

A waste container disclosed in U.S. Pat. No. 2,970,533 comprises a rigid container with an open top, the container including two sections: a first fixed and a second hinged, which is pivotally connected to a base of the container. The shape of a ram head is coincident with that of a disposable bag placed in the container. A foot treadle pivotally hinged to the base is connected to an arm extending perpendicularly from the ram head by means of which the foot treadle is depressed to place the ram head within the bag and compress the waste material.

U.S. Pat. No. 2,641,122 describes a hydraulic expressor for expelling liquid from wet material by squeezing it by an electrically operated hydraulic press. A movable bottom member of the container is adapted to carry out the material subject to compression between the head member and the reciprocable ram.

U.S. Pat. No. 56,456 describes a baling press for cotton and the like, which is manually operated and comprises a set of baling trunks mounted on wheels, which run on a suitable railway. The device also comprises a frame, a hand wheel with a crank and spokes, while the motion is transferred through a number of spur-wheels and pinions from a hand-wheel to a rack which descends and presses the cotton in a trunk.

The present invention solves the prior art problems and shortcomings in a simple and straightforward manner by providing an apparatus which allows trash as accumulated on an offshore oil or gas platform or other such commercial installation to be compacted in readily available flexible bags or in disposable drums such as, for example, standard commercially available fifty-five gallon drum.

The present invention provides an apparatus which allows refuse to be compacted within a drum with the same apparatus also being capable of compacting trash within a bag and further being capable of crushing fifty-five gallon or like disposable drums.

3. General Discussion of the Present Invention

The present invention provides a compactor apparatus for use with disposable drums and flexible bags which provides a supportive frame having a runway supporting a movable compaction platform. A jacket assembly is removably positioned during operation on the platform and about a drum or a bag to provide support against lateral deformation during compaction and to support and contain refuse being compacted as when a bag is used. A hydraulic ram having a compaction disk attached to it is positioned vertically above the platform and the disposable drum or bag. The ram compacts trash within the jacket assembly during extension of the cylinder. During such compaction the drum or bag is supported against lateral deformation by the jacket and against vertical deformation by the platform. The jacket assembly comprises, in the preferred embodiment, a cylindrical jacket which is split into two half-cylindrical portions of substantially equal size which are, for example, hingedly connected at one edge portion with latches being provided opposite the hinge to secure the cylindrical jacket assembly in a closed position during compaction. The platform is movably mounted on the runway being provided with grooved casters, the grooves of the casters resting on rails provided on the runway and allowing the platform to be rolled between compacting (under the ram) and unloading (removed laterally away from the ram) positions. A safety feature to insure centering of the jacket under the ram provides a microswitch and an adjustable stop behind the runway which stops rearward travel of the platform and indexes the platform and jacket under the ram, with proper indexing tripping the microswitch to energize an operating circuit.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
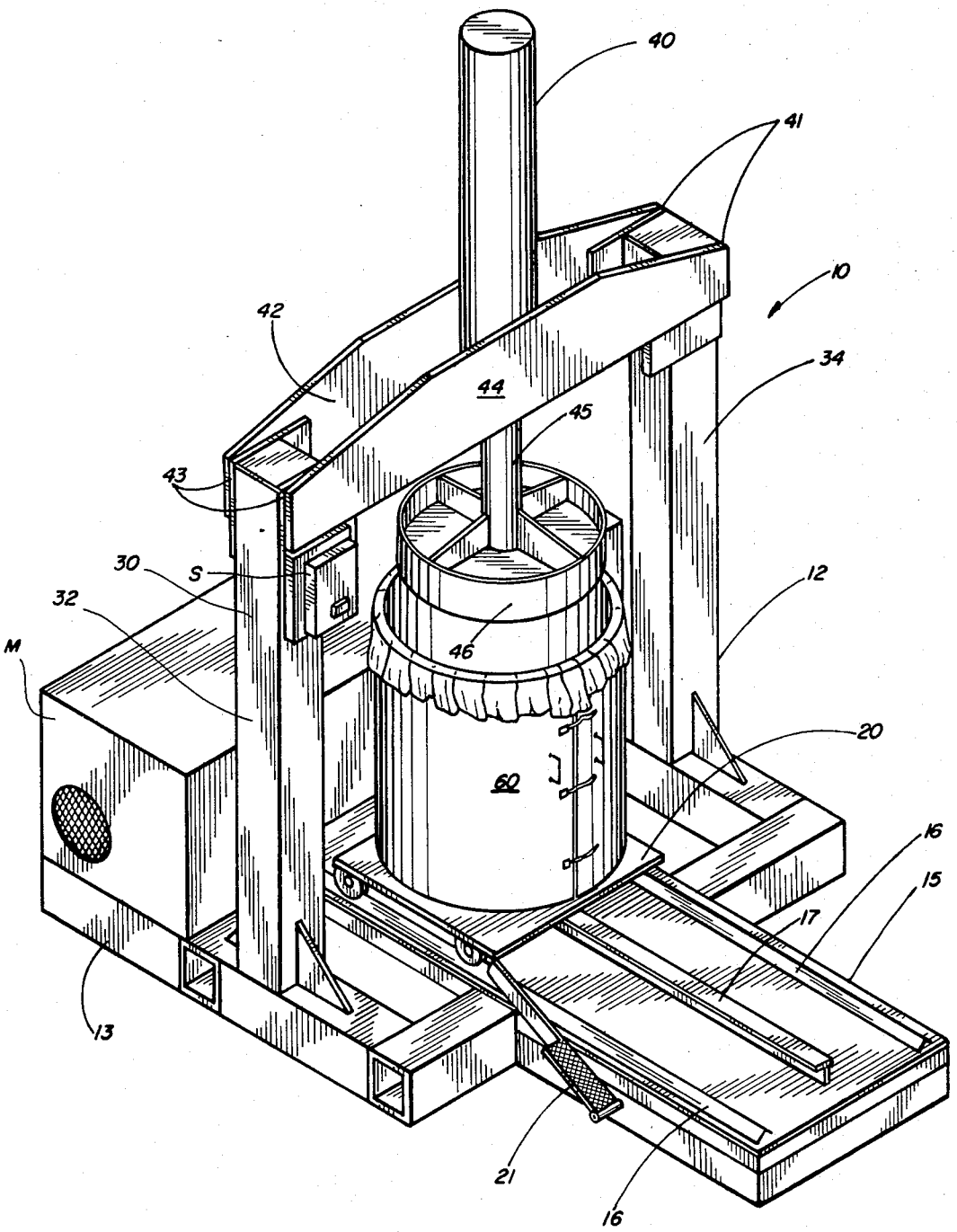
FIG. 1 is a perspective view of the preferred embodiment of the apparatus of the present invention.

FIG. 1 shows an overall view of the preferred embodiment of the apparatus of the present invention designated generally by the numeral 10. Compacting apparatus 10 comprises generally a supportive frame 12 having a lower horizontal base 13 providing runway 15 which supports movable platform 20. Attached to base 13 is upper superstructure 30 supporting cylinder 40 vertically above platform 20, which can be a hydraulically operated cylinder. Also provided as shown in FIG. 1 is jacket assembly 60 which during operation rests upon platform 20.

Figure 11:
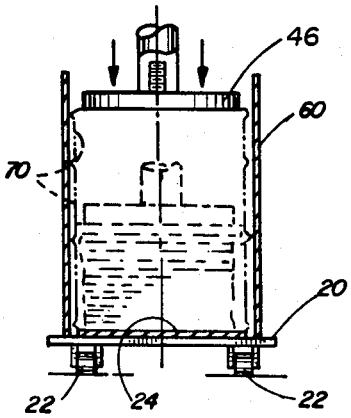
FIG. 11 is a partial schematic sectional view of the preferred embodiment of the apparatus of the present invention illustrating compaction of refuse inside a drum.
Figure 9:
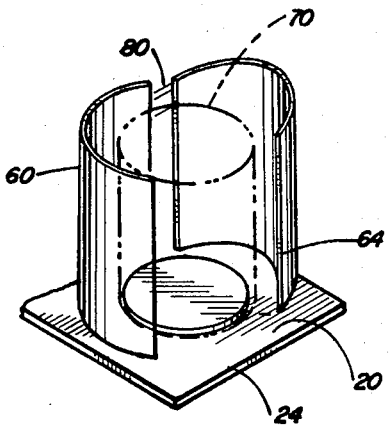
FIG. 9 is a partial perspective view of the preferred embodiment of the apparatus of the present invention illustrating the jacket portion thereof in an open position.
Figure 10:
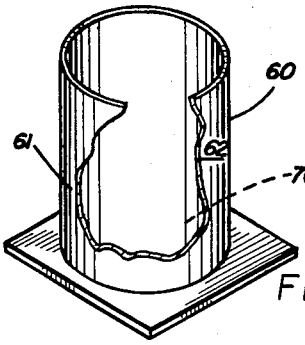
FIG. 10 is a perspective view of the preferred embodiment of the apparatus of the present invention illustrating the jacket portion thereof as assembled about a drum.

Cylinder 40 is provided with an extendable ram 45 portion which has attached to its lower end thereof a circular compaction disk 46. Disk 46 would preferably be of an external diameter (OD) substantially identical to or smaller than the inner diameter (ID) of a provided disposable drum 70 which would be placed during the compacting operation within jacket 60. Drum 70 and its position within jacket 60 is best seen in FIGS. 9–11.

Figure 2:
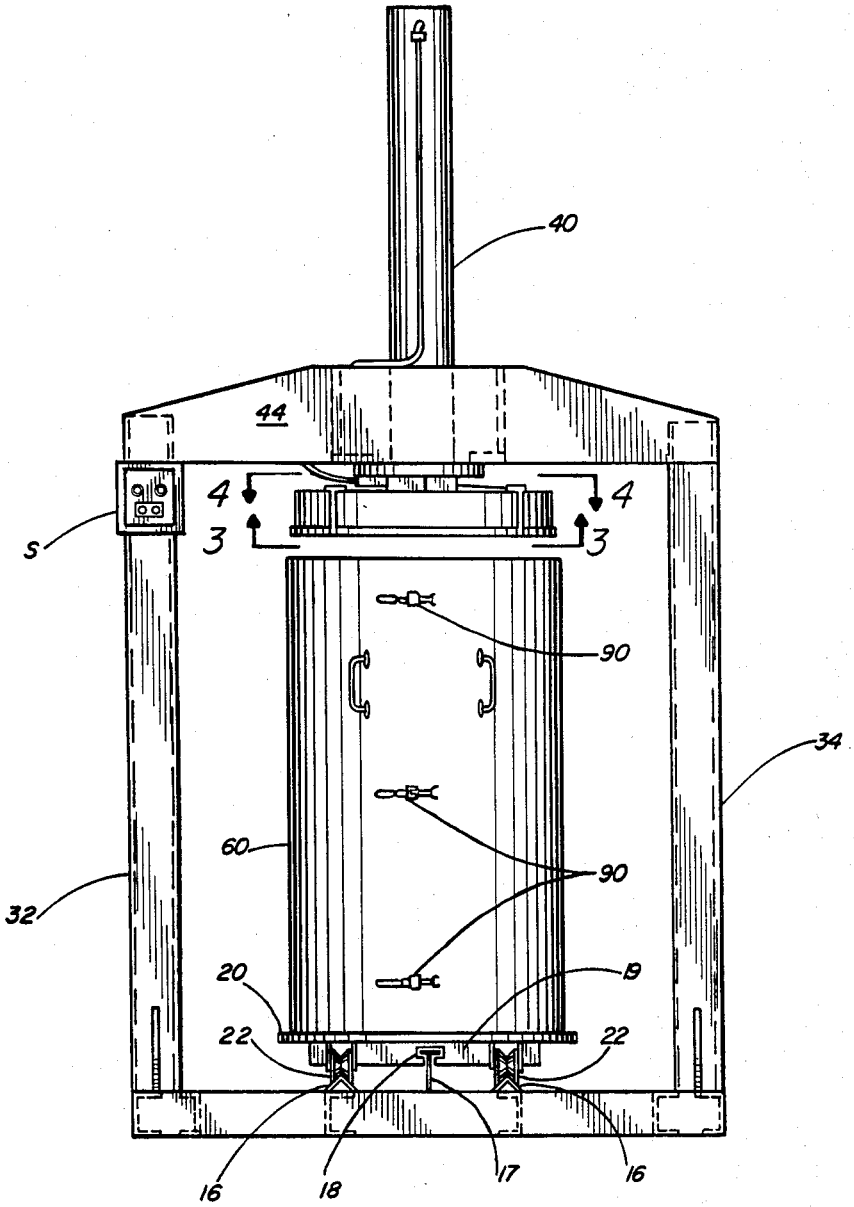
FIG. 2 is a front elevational view of the preferred embodiment of the apparatus of the present invention.
Figure 18:
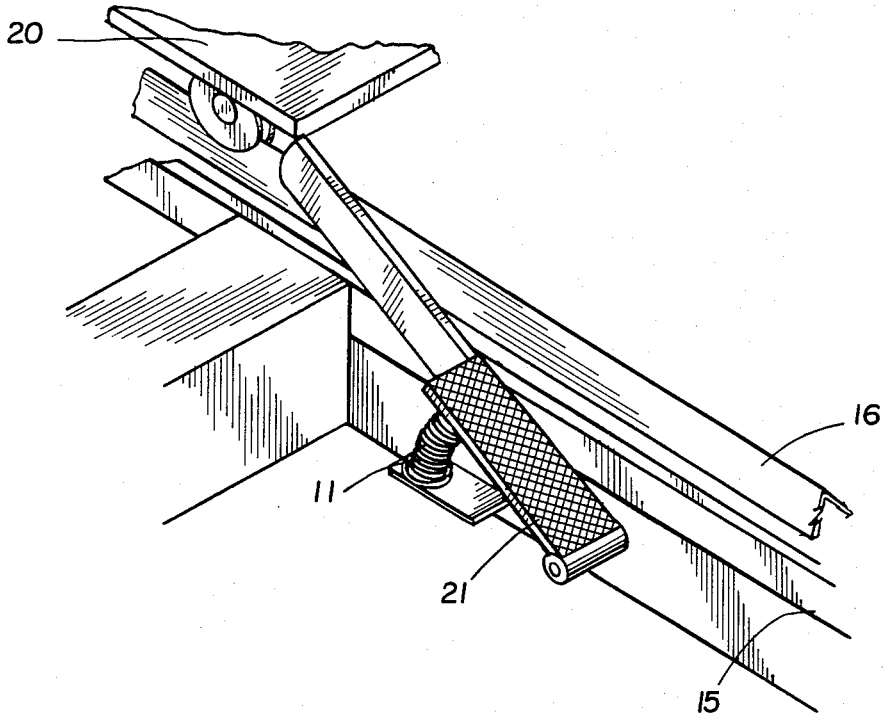
FIG. 18 is a fragmentary detail view of the preferred embodiment of the apparatus of the present invention illustrating the spring actuated pedal.

Platform 20 would normally be movably mounted upon runway 15 of frame 12 by supplying platform 20, for example, with grooved casters 22 as best seen in FIG. 2. Runway 15 can have spaced rails 16 which engage grooved casters 22 to discourage lateral movement of platform 20 with respect to runway 15 yet allow fore-aft movement. An anchor 17 such as a tee-beam welded to runway 15 and parallel to rails 16 would retain platform 20 on runway 15, discouraging its removal by tipping, for example. A tee-shaped recess 18 in platform 20 which could be in cross beam 19 of platform 20 would cooperate with the anchor tee-beam 17 to provide the desired anchor assembly. A stop pedal 21 could be, for example, hingedly affixed to runway 15, and be normally biased upwardly by means of spring 11, as best shown in FIG. 18. It should be noted that any other similar means of attachment of pedal 21 to runway 15 could be successfully employed. Foot pressure on pedal 21 would disengage it, allowing platform 20 to roll outwardly from its operative position under cylinder 40.

Figure 7:
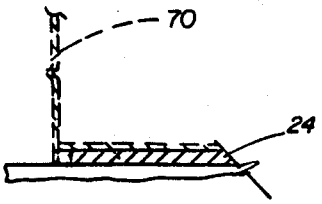
FIG. 7 is a fragmentary detail view of the preferred embodiment of the apparatus of the present invention illustrating the compaction platform and indexing disk portions thereof.

Lower indexing disk 24 would be attached by welding, for example, to platform 20 at its center and would provide extra thickness to platform 20 at the compacting area to prevent rupture of a drum at its bottom and would further provide a means for properly indexing jacket 60 or drum 70 to platform 20 (see FIG. 7). Indexing disk 24 would be, for example, of an external diameter (OD) substantially equal to the internal diameter (ID) of a drum 70 placed thereover.

Figure 6:
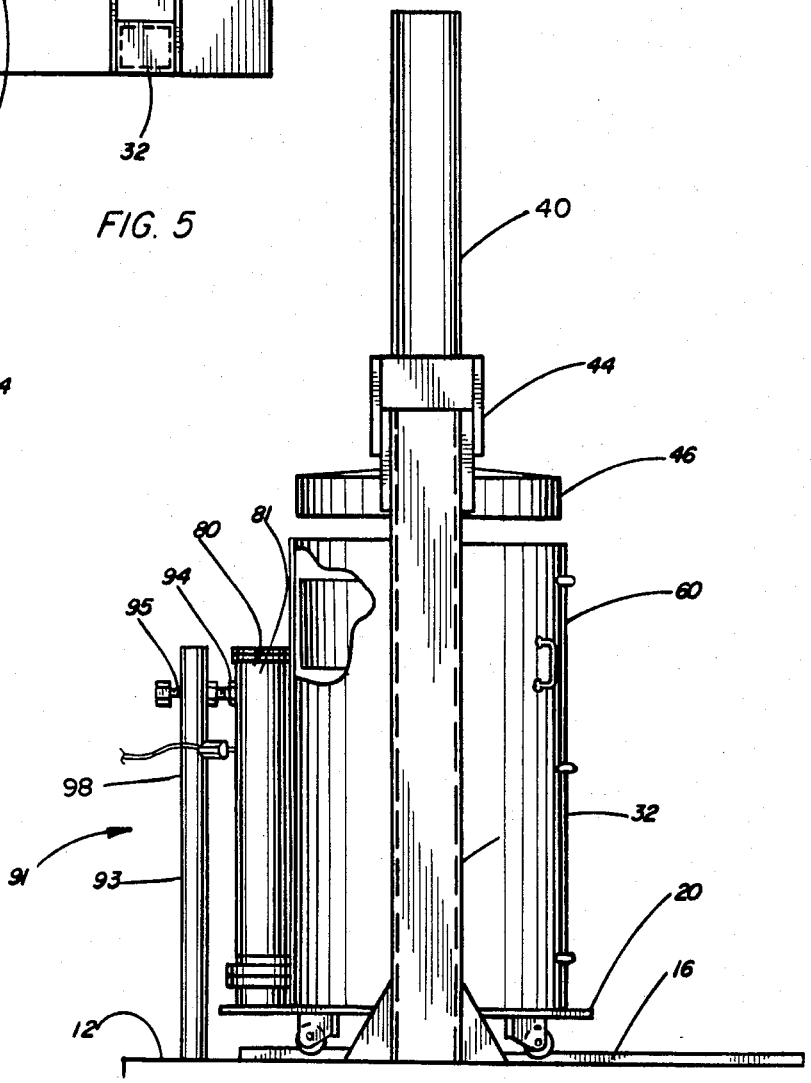
FIG. 6 is a side view of the preferred embodiment of the apparatus of the present invention.
Figure 8:
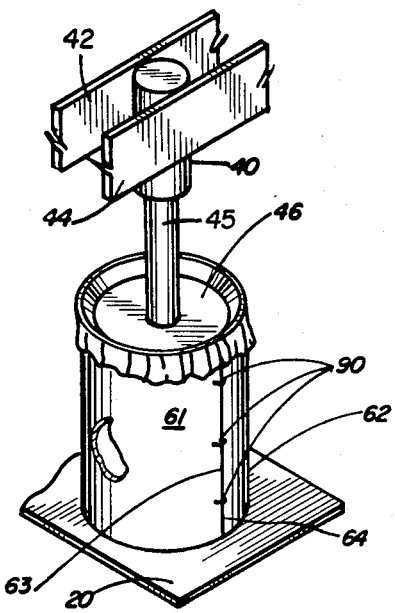
FIG. 8 is a partial perspective view of the preferred embodiment of the apparatus of the present invention schematically illustrating compaction of refuse in a bag.

Frame 12 would comprise a supportive base 13 which could be, for example, rectangular, being manufactured of steel construction or the like with a superstructure 30 having a pair of vertical columns 32, 34 which were attached at their bottom to base 13 with reinforcement by gusseting as shown in FIGS. 1–2 and 6, with columns 32, 35 supporting horizontal support beams 42, 44 which are attached at their end portions at 41, 43 to columns 32, 35 by welding, for example. At the central portion of beams 42, 44 cylinder 40 is attached being vertically oriented to operate in a substantially vertical direction above jacket 60. Cylinder 40 would be aligned so that its ram 45 portion when extended would move compaction disk 46 in a vertical direction downwardly into the inner portion of jacket 60 and a provided bag or disposable drum 70 as desired. The connection of cylinder 40 to beams 42, 44 could be, for example, by welding, bolting, or the like. The spacing of beams 42, 44 could be of a distance as shown in FIG. 1 which would allow for the placement of cylinder 40 therebetween with cylinder 40 being attached at opposite sides to beams 42, 44 respectively.

Cylinder 40 could be operated, for example, by a hydraulic motor which is schematically illustrated by the letter M in FIG. 1. Electrical switching could be provided for powering motor M with switching S being schematically shown in FIG. 1 also.

Figure 17:
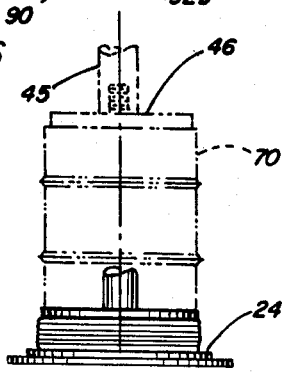
FIG. 17 is a partial elevational view of the preferred embodiment of the apparatus of the present invention illustrating schematically crushing of a drum.

Compaction disk 46 could be as aforementioned of a diameter equal to the internal diameter of a provided disposable drum 70 which could be, for example, a standard fifty-five gallon drum. Disk 46 could be removably attached to ram 45 by bolting, threading, or the like so that an enlarged disk could be provided having a diameter greater than the external diameter of drum 70 which would allow compaction of a fifty-five gallon or like disposable drum itself when jacket 60 were removed from its position on platform 20. This would allow drums themselves to be compacted for disposal should that be desirable. Drums 70 could be compacted using compaction disk 46 if the top of the drum were left on, or if the drum were inverted, with the disk 46 engaging the bottom of the drum 70 during compaction (see FIG. 17).

Figure 3:
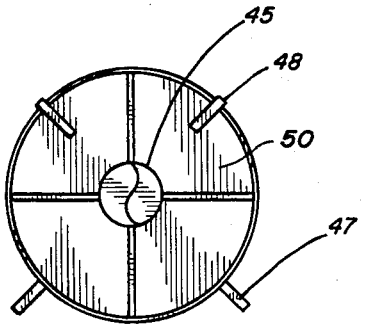
FIG. 3 is a sectional view taken along lines 3—3 of FIG. 2.
Figure 4:
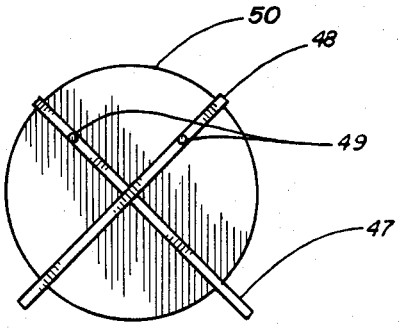
FIG. 4 is a sectional view taken along lines 4—4 of FIG. 2.

FIGS. 3 and 4 show an alternate compaction disk arrangement using disk 50, which is similar to disk 46 in FIG. 1, but adding a pair of bars 47, 48 which might be attached at their intersection by means of a pinned connection or the like and having a pair of attachments at 49 which might be, for example, bolted connections for bolting the pair of bars 47, 48 to disk 50. Note that an enlarged diameter is thus provided which would allow crushing of a drum 70 even if the top were not available for it. Thus, an enlarged diameter for engaging the top of the drum would be provided by using the cross bar arrangement of FIGS. 3 and 4.

Jacket 60 comprises generally a pair of jacket halves 61, 62 which are substantially equally sized and are attached along their rear edges together at hinge 80 and at their front edges 63, 64 by means of latches 90.

Figure 12:
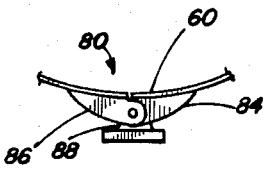
FIG. 12 is a top fragmentary view of the hinge portion of the preferred embodiment of the apparatus of the present invention.
Figure 13:
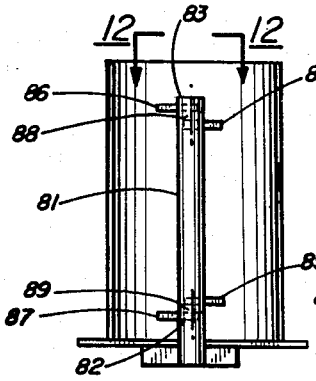
FIG. 13 is a fragmentary rear view of the preferred embodiment of the apparatus of the present invention.
Figure 14:
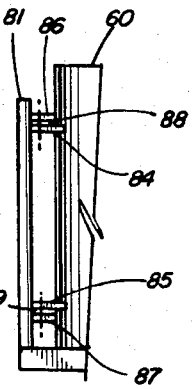
FIG. 14 is a fragmentary side view of the preferred embodiment of the apparatus of the present invention.

The construction and operation of hinge 80 is seen in FIGS. 12–14. Hinge 80 would comprise a vertical hinge plate 81 with connections 82, 83 at which each jacket half 61, 62 would attach pivotally thereto, allowing the halves 61, 62 to diverge as seen in FIG. 9. Hinge 80 provides a pair of upper hinge elements including upper elements 84, 86 and lower elements 85, 87. Hinge elements 84–85 and 86–87, as above disclosed, and as shown in FIG. 13, would bolt, for example, to horizontal hinge plates 88, 89 which are welded, for example, to vertical plate 81.

Figure 15:
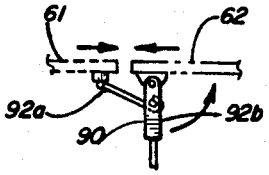
FIGS. 15–16 are partial top views of the preferred embodiment of the apparatus of the present invention illustrating the locking latch portions of the jacket.
Figure 16:
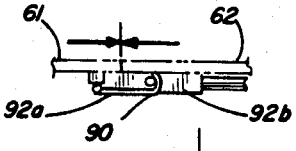

Latch 90 having latch halves **92*a*, 92*b* is seen in FIGS. 15–16. Such latches 90** are commercially available.

Figure 5:
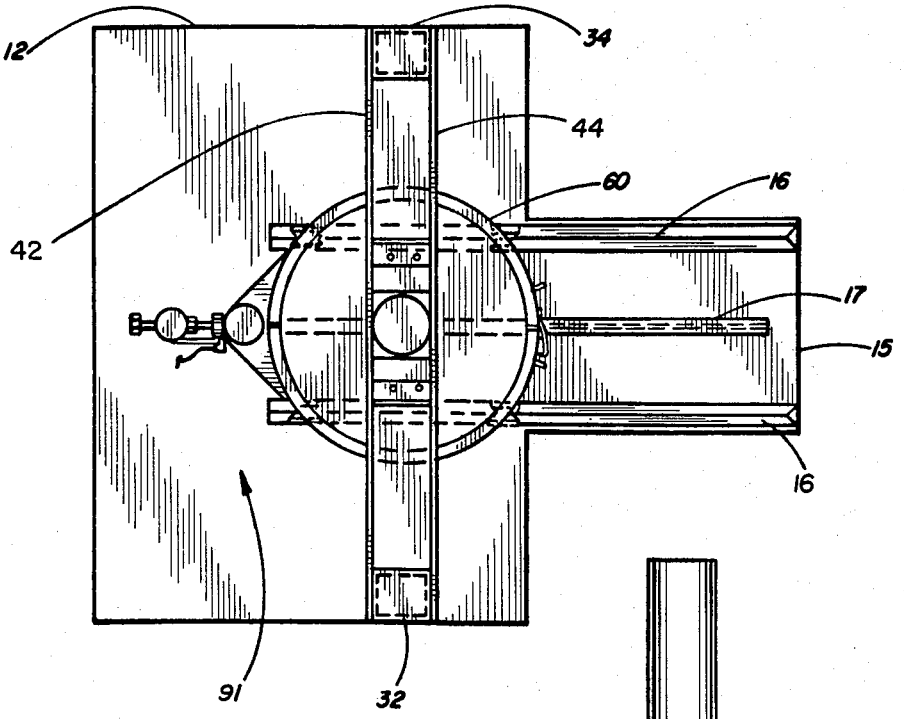
FIG. 5 is a top view of the preferred embodiment of the apparatus of the present invention.

FIGS. 5 and 6 show a safety indexing arrangement designated generally by the numeral 91. An adjustable bolt 95 is attached to, for example, any part of frame 12 which in FIGS. 5 and 6 is a provided column 93. It should be understood however, that adjustable bolt 95 could be attached to any portion of frame 12 which would be of suitable structural integrity. Adjustable bolt 95 would be threadably attached, for example, allowing it to move fore and aft with respect to frame 12 and thus change the position of a provided stop 94 at the end portion of bolt 95 adjacent hinge 80. Bolt 95 provides an adjustability as to the rearmost position which platform 20 will travel when jacket 60 is assembled thereupon. Adjustable bolt 95 could be provided to abut against either hinge 80, jacket 60, or platform 20 as desired. In combination with adjustable stop bolt 95 there is provided a microswitch 98. Microswitch 98 would be switched on to energize the electrical circuit operating motor M and switch box S when the proper indexing position was achieved by either runway 20 or jacket 60. Thus, by providing an adjustable stop and a switching arrangement for energizing the circuit when the platform 20 were properly registered vertically under cylinder 40, a safety system is provided which will disallow operation of the device unless the material to be compacted were properly oriented under cylinder 40 and compaction disk 46.

Apparatus 10 could be manufactured of, for example structural steel or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A refuse compacting apparatus comprising:

a. a frame, said frame providing a horizontal base and an upwardly extending superstructure, rigidly attached to said base;

b. a hydraulic cylinder having a movable driven ram portion and being mounted on said superstructure and being vertically oriented for extending said ram portion of said cylinder in a downward direction;

c. a compaction disk attached to a lowermost end of said ram portion and being movable with said ram portion from an upper idle position to a lower operating position;

d. a movable compaction platform securedly mounted on said base beneath said cylinder during a compacting operation and slidably removable from said base during an unloading operation;

e. an open-ended cylindrical jacket assembly adapted to receive the refuse to be compacted, said jacket assembly being adapted to be releasably attached to said compaction platform and having a hinged portion on one side of a side wall and latches on diametrically opposite side of the side wall for assembling said jacket in the cylindrical operational position and disassembling it in an open-wall position during non-operation;

f. a runway portion extending upwardly from said frame to facilitate movement of said compaction platform and said jacket assembly attached thereto between an operating position when said platform is beneath said cylinder and on-operating position laterally removed from said frame, said runway portion being provided with a pair of parallel spaced apart rails and an I-beam fixedly attached between said rails, and platform being provided on its undersides with a plurality of castors slidably engaging said rails and a T-shaped groove for slidable engagement with said I-beam of said runway portion, this combination of the rails, the castors, the I-beam, and the groove facilitating back and forth movement of said platform along said runway.

2. The apparatus of claim 1, wherein it further comprises a spring-action, foot actuated lever mounted to said runway, for preventing lateral movement of said platform while in said operating position, and which is actuatable by foot pressure for allowing movement of said compaction platform into said non-operating position on said runway portion.

* * * * *